US005368433A

United States Patent [19]

Seyffert

[11] Patent Number: 5,368,433

[45] Date of Patent: Nov. 29, 1994

[54] DRUM DUMPER

[75] Inventor: Kenneth W. Seyffert, Houston, Tex.

[73] Assignee: Environmental Procedures, Inc., Houston, Tex.

[21] Appl. No.: 91,554

[22] Filed: Jul. 14, 1993

[51] Int. Cl.[5] ..... B65G 65/23

[52] U.S. Cl. ..... 414/412; 414/415; 414/421

[58] Field of Search ..... 414/411, 412, 415, 419, 414/421, 303, 304, 291; 222/83.5; 134/166 R; 55/220

[56] References Cited

U.S. PATENT DOCUMENTS

| | | | |
|---|---|---|---|
| 2,822,113 | 2/1958 | Joiner, Jr. | 414/421 X |
| 3,347,399 | 10/1967 | Ensinger | 414/421 |
| 3,467,267 | 9/1969 | Van Elten | 414/412 |
| 3,487,965 | 1/1970 | Gale | 414/412 X |
| 3,502,233 | 3/1970 | Mevissen et al. | 414/421 X |
| 3,739,471 | 6/1973 | Peres | 414/412 X |
| 3,906,733 | 9/1975 | Koppers | 55/220 X |
| 4,708,571 | 11/1987 | Sappok | 414/412 |
| 4,735,368 | 4/1988 | Janko et al. | 414/412 X |
| 4,999,021 | 3/1991 | Reissmann | 414/415 |
| 5,190,429 | 3/1993 | Harlegaard | 414/412 |

FOREIGN PATENT DOCUMENTS

| | | | |
|---|---|---|---|
| 267950 | 3/1964 | Netherlands | 414/421 |
| 582154 | 11/1977 | U.S.S.R. | 414/421 |

OTHER PUBLICATIONS

Grainger Catalog, Drum Equipment, pp. 580–583, 1990.

Catalog 96, McMaster-Carr Supply Company, pp. 300–304, 1990.

*Primary Examiner*—David A. Bucci

*Attorney, Agent, or Firm*—Guy McClung

[57] ABSTRACT

Devices and method are disclosed for opening, e.g. by puncturing, sealed containers of materials, e.g. drums filled with toxic or hazardous substances. In one aspect a support cradle supports one or more containers and is movable to dump their contents into a discharge hopper. In one aspect containers are punctured or opened by movable spears or cutters which are movable to open the containers, preferably with personnel spaced apart from or remote from the apparatus during operation. A variety of spray devices or nozzles may be used to create fogs or protective fluid sheets or films over or about various parts of the apparatus to inhibit unwanted dispersion of material in the containers.

12 Claims, 6 Drawing Sheets

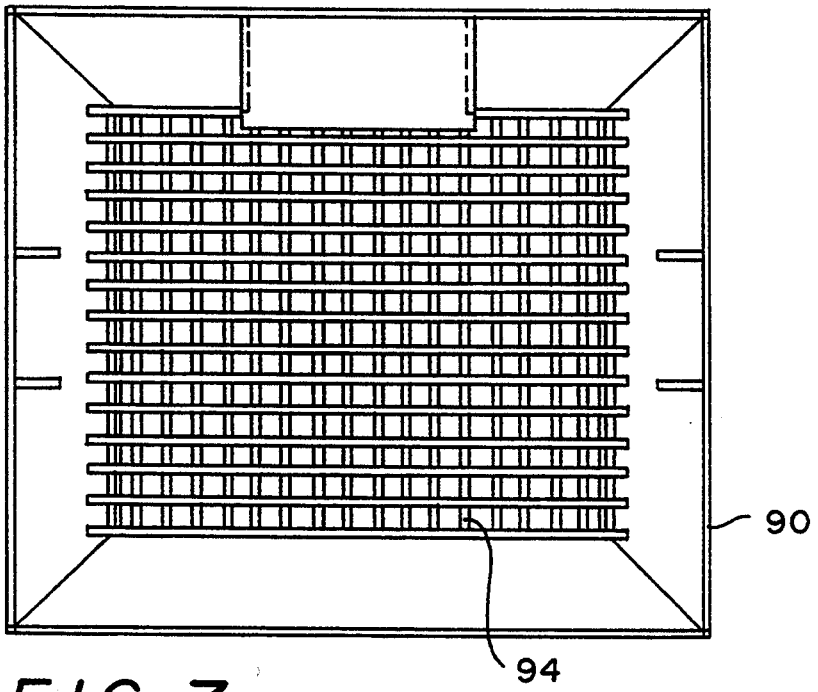
FIG. 7
FIG. 8
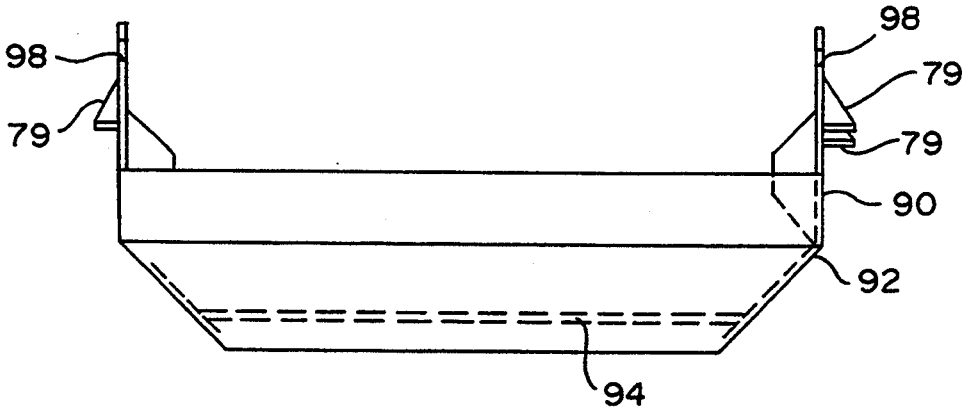
FIG. 9
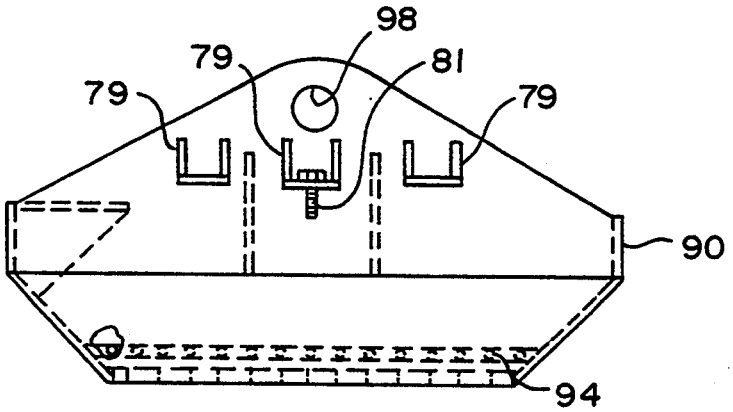

DRUM DUMPER

BACKGROUND OF THE INVENTION

1. Field of the Invention

This invention relates to the emptying of containers; to the puncturing of sealed containers; to inhibiting the dispersion of materials from containers; to moving containers of materials to facilitate the removal of their contents; and in one aspect to such things useful with emptying containers such as drums filled with dangerous, toxic, or hazardous materials.

2. Description of Related Art

The art discloses a variety of containers for materials, including both liquid and solid materials. Some containers have lids or closure members which are removably clamped over a container opening. Other containers have closure members which are bonded or welded over an opening. Depending on the nature of the material in the container, it is possible for pressure to build up in the container. Puncturing such a container or releasing a clamp holding a lid on such a container can result in a dangerous pressure release and an undesirable expulsion of the lid and of material in the container.

Once a container has been opened, removal of its contents may result in spillage or in introduction of material into the surrounding atmosphere. Varying amounts of material may remain in the container requiring additional steps for removal.

There has long been a need for effective devices and methods for removing materials from containers. There has long been a need for such devices and methods for safely dealing with dangerous, toxic, or hazardous materials. There has long been a need for effective and safe devices and methods for puncturing, opening and/or moving such containers. There has long been a need for such devices and methods in which unwanted dispersion of materials from an opened container is inhibited or controlled.

SUMMARY OF THE PRESENT INVENTION

The present invention, in one aspect, discloses a system for opening and emptying containers of materials, the system including puncturing apparatus for puncturing the top of one or more containers; tilting apparatus for tilting one or more opened containers; and reception-apparatus for receiving the materials flowing from the tilted opened container(s).

In one aspect the present invention employs one or more fog and/or spray creating devices, e.g. but not limited to spray nozzles, to create either an inhibiting liquid fog or a liquid spray film or wall to inhibit the spread or dispersion of material from an opened container. Such fog(s) and/or spray(s) may be utilized at any point in the system at which there is a risk of unwanted material release or dispersion. Suitable fog or spray material may include water or any other desirable fluid, gas (e.g. inert gas), foam, fire retardant material or chemical and such fog(s) or spray(s) may be used with containers of solid or liquid materials. In another aspect, a directed spray or sprays may be used to facilitate the emptying of containers and dislodgement and removal of material from within containers.

In one embodiment a single puncturing spear is used to puncture a sealed lid on a container such as a typical drum of hazardous material. Personnel then remove the lid prior to tilting the container. In another embodiment multiple spears are used so that a sufficient number of openings are made of sufficient size that the lid need not be removed. In another embodiment a single cutter of sufficient size is used to cut a large hole in a container's lid or to cut away substantially all of the lid. Thus if lid removal is not required since the openings are of sufficient size to tilt the container and have the material therein flow out, personnel are not required to remove the lid. Also, in such an embodiment, tilting of the container can be initiated at a location apart from or remote from the apparatus to reduce the exposure of personnel to dangerous materials.

In one aspect this invention provides a movable cradle for the one or more material containers. The cradle provides a support for the containers while they are being punctured or opened and, in one aspect, provides for movement of the container(s) upon inversion to impact against part of the cradle to jar loose material within the container(s). The cradle is movable so that the material from the container(s) flows into the reception apparatus.

In one embodiment the reception apparatus includes a vibrating basket which facilitates the passage of the material through a screen or grid and to a discharge hopper.

It is, therefore, an object of at least certain preferred embodiments of the present invention to provide:

New, useful, unique, efficient, non-obvious devices and methods for opening and emptying containers;

Such devices and methods which puncture or open a container to safely relieve pressure built up therein;

Such methods and devices which inhibit or control the undesirable dispersion of a container's contents to the environment;

Such methods and devices which limit or totally eliminate the need for personnel working in close proximity to containers of dangerous, toxic, and hazardous materials;

Such devices and methods in which containers are jarred to facilitate the removal of material therefrom; and Such devices and methods in which fluid under pressure is directed into containers to facilitate the removal of material therefrom.

This invention resides not in any particular individual feature disclosed herein, but in combinations of them and it is distinguished from the prior art in these combinations with their structures and functions. There has thus been outlined, rather broadly, features of the invention in order that the detailed descriptions thereof that follow may be better understood, and in order that the present contributions to the arts may be better appreciated. There are, of course, additional features of the invention that will be described hereinafter and which may be included in the subject matter of the claims appended hereto. Those skilled in the art who have the benefit of this invention will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar as they do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

FIG. 7 is a top view of a vibratable basket according to the present invention.

FIG. 8 is a side view of the basket of FIG. 7.

FIG. 9 is another side view of the basket of FIG. 7.

DESCRIPTION OF EMBODIMENTS PREFERRED AT THE TIME OF FILING FOR THIS PATENT

Figure 1:
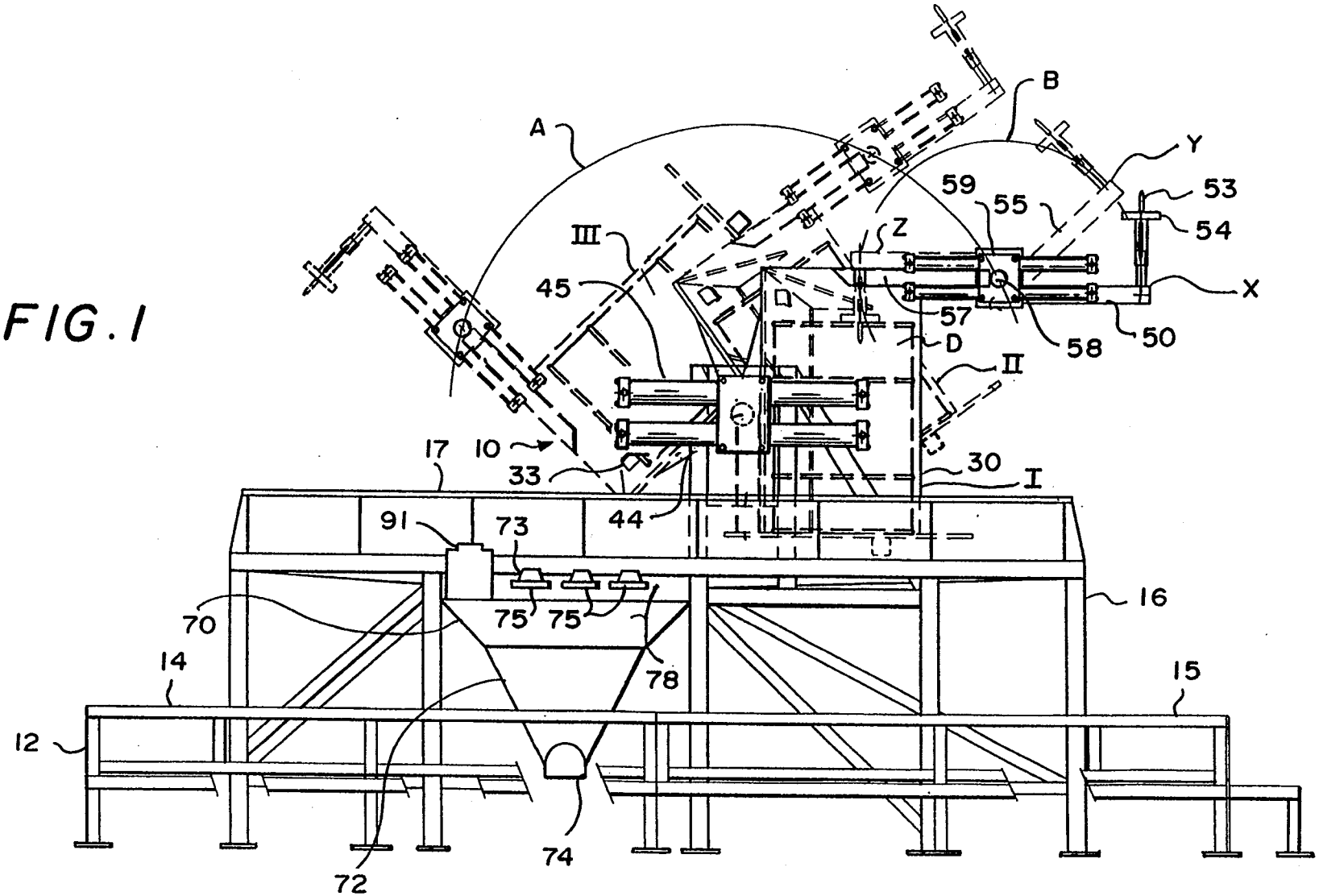
FIG. 1 is a side view of an apparatus according to this invention with devices according to this invention.
Figure 2:
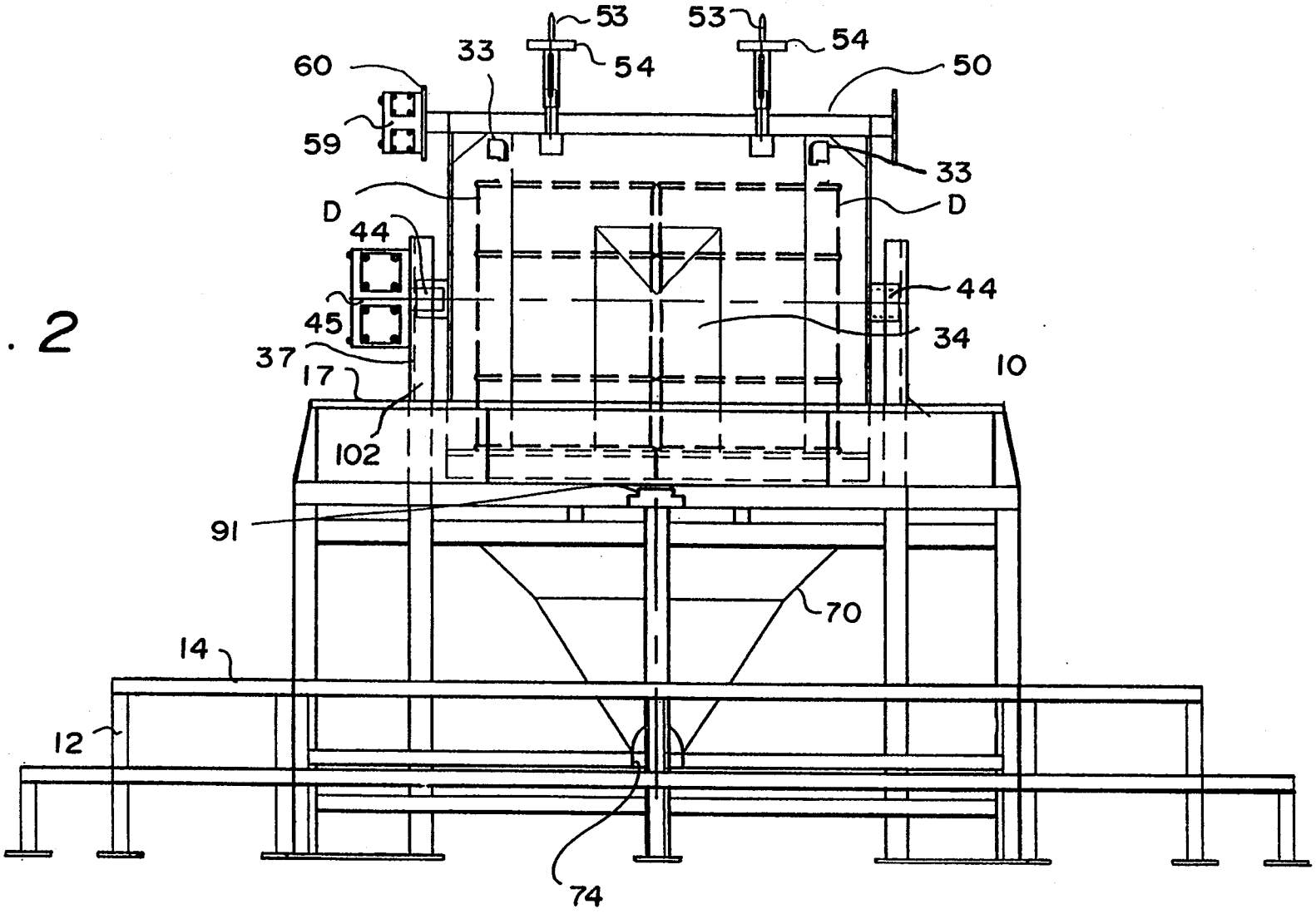
FIG. 2 is an end view of the apparatus of FIG. 1.
Figure 3:
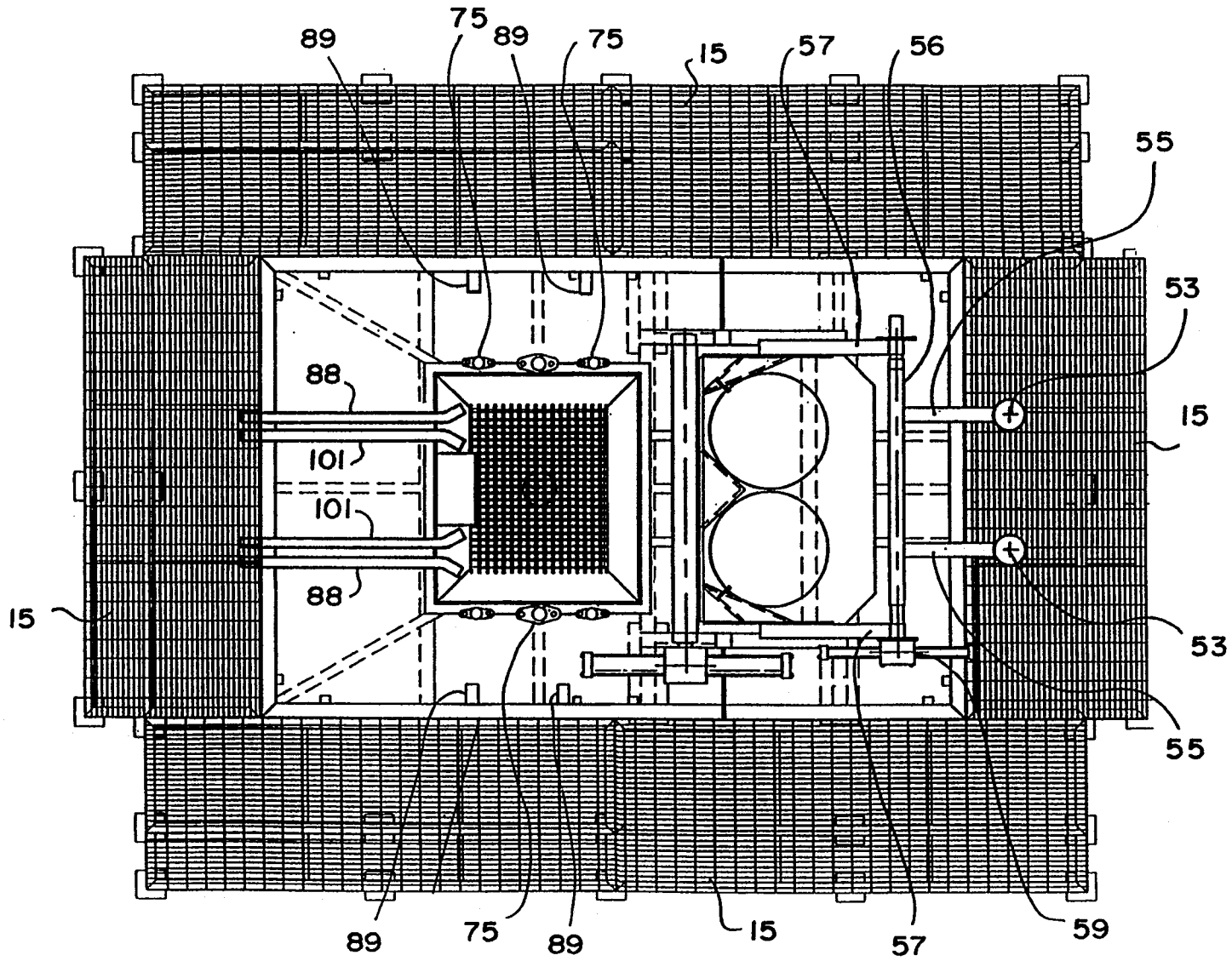
FIG. 3 is a to view of the apparatus of FIG. 1.
Figure 4:
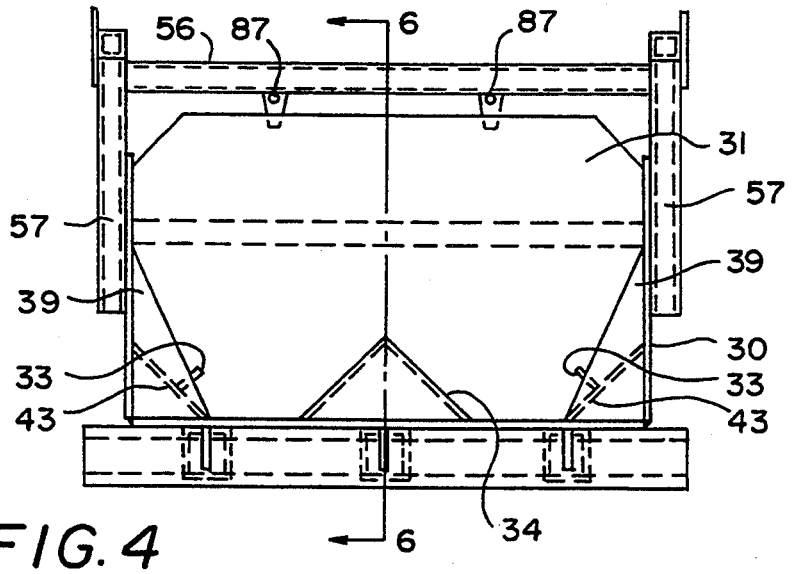
FIG. 4 is a top view of a container support according to the present invention.
Figure 5:
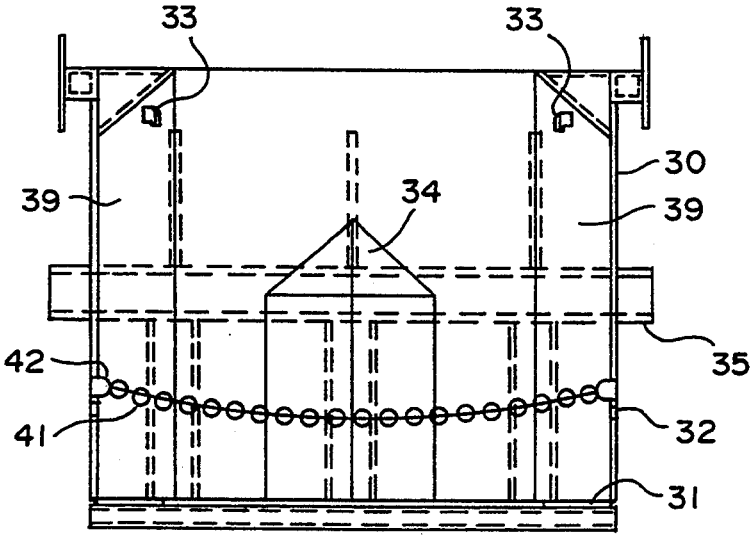
FIG. 5 is a front view of the support of FIG. 4.
Figure 6:
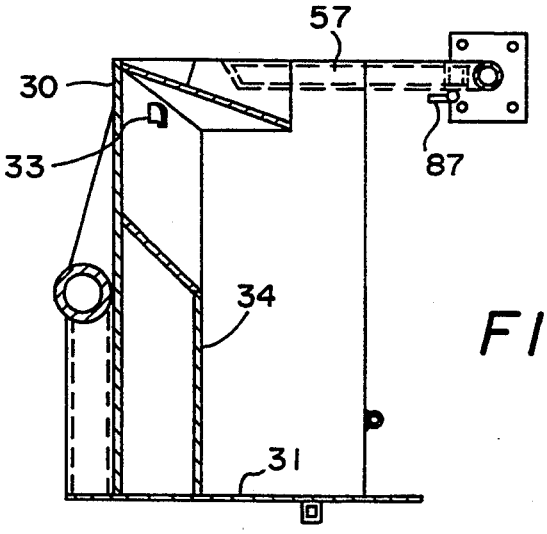
FIG. 6 is a side view of the support of FIG. 4.
Figure 10:
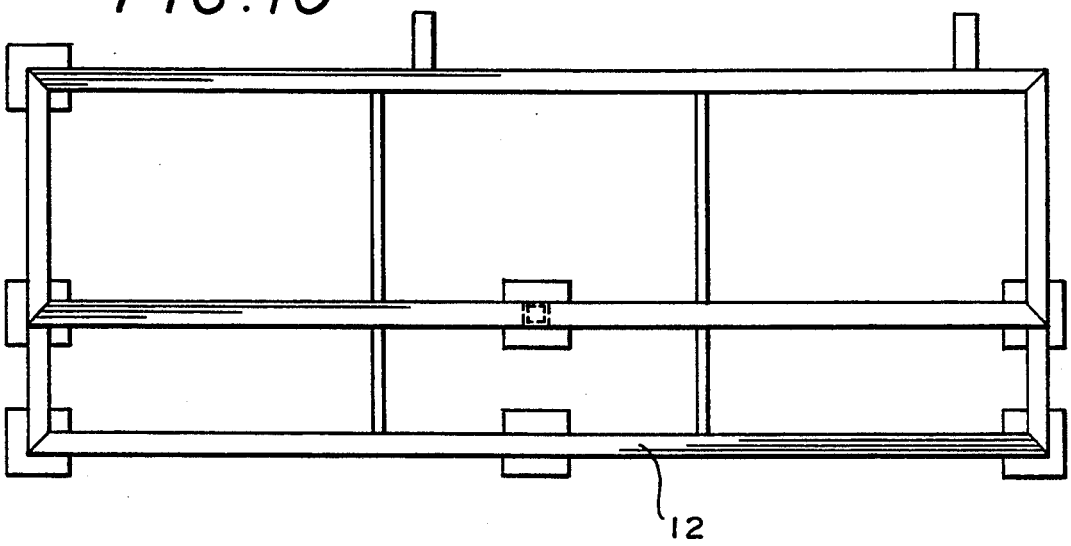
FIG. 10 is a top view of a part of a base for the apparatus of FIG. 1.
Figure 11:
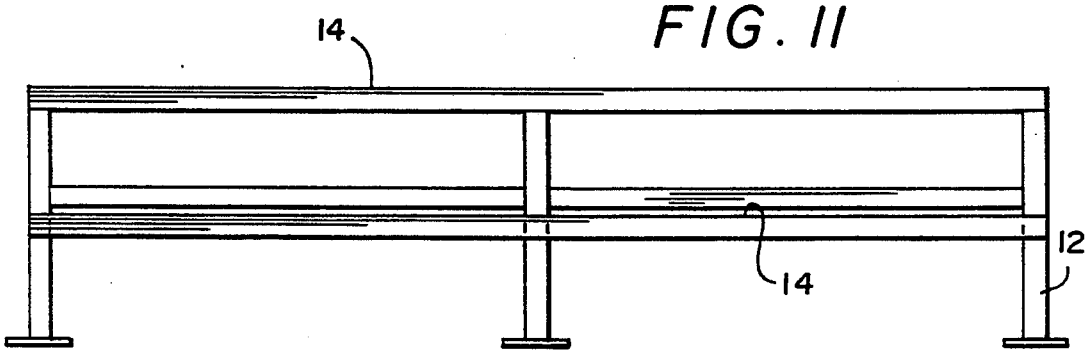
FIG. 11 is a side view of the base of FIG. 10.
Figure 12:
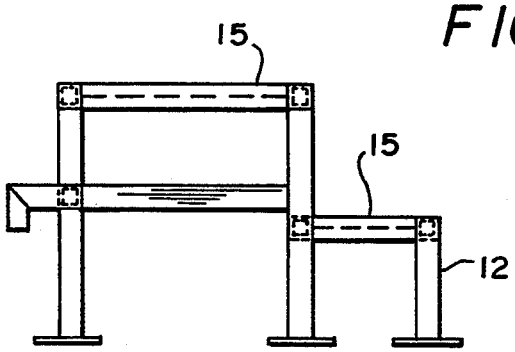
FIG. 12 is an end view of the base of FIG. 10.

Referring now to FIG. 1, an apparatus 10 according to the present invention is encompassed by a walkway base support 12 and a walkway 14 including removable steel grid panels 15. An apparatus support 16 with a railing 17 supports various mechanisms of the apparatus 10.

The apparatus 10 has a container support cradle 30 according to the present invention with a container puncturing or opening device 50 according to the present invention movably mounted thereto. The device 50 could be mounted to the apparatus support 16 if desired. The apparatus 10 also has reception apparatus 70 according to the present invention with a removable vibratable basket 90 according to the present invention.

As shown in FIGS. 1 and 4–6, the container support cradle 30 has a bottom shelf 31, sides 32, and a releasable retaining chain 41 hooked to hooks 42. A central separator member 34 is disposed and configured to maintain two drums on the bottom shelf 31 in spaced apart relation while they are on the cradle 30. Catch hooks 33 secured on end plates 43 are positioned to catch and hold a drum D when it moves downwardly under the force of gravity as the cradle moves to tilt the drum D. The distance between the hooks 33 and the top of the drum D is, preferably, chosen so that the drum D moves a sufficient distance to hit the hook with enough of an impact to facilitate emptying of material from the drum; e.g. with enough force to jar loose coagulated or agglomerated solid particulates adhering to the drum's interior surface or held therein by material bridging across the drum's interior. Deflector plates 39 serve to direct the flow of material to the reception apparatus 70 as the drum(s) are tilted and material flows therefrom.

A shaft 44 (see FIG. 1) extends through a shaft tube 35 and the cradle 30 rotates and is rotatable on this shaft. An hydraulic actuator 45 interconnected with the shaft 44 and mounted by its mount plate 37 to a mount post 102 is actuable to move the cradle 30 in the arc A as shown in FIG. 1. FIG. 1 shows three positions, I, II, III of the cradle 30. As shown in position III, the drum D has moved to jar against the hook 33. Material flowing from the drum D dumps into the reception apparatus 70.

Prior to dumping of the drum D, if the drum D has a sealed lid or top, (either a lid welded or bonded to the drum or a lid clamped on the drum), the puncturing device 50 is movable to puncture the top of the drum D or, if a larger cutter is used, to open a substantial hole in the top of the drum D. Spears 53 are mounted on arms 55 which are secured to a bar 56. The bar 56 is secured to arms 57 mounted rotatably on a shaft 58. An hydraulic actuator 59 interconnected with the arms 57 and mounted by its mount plate 60 welded to one of the arms 57 is actuable to rotate the bar 56 and spears 53 in the are B shown in FIG. 1. FIG. 1 shows three positions of the bar 56 and spears 53, positions, X, Y, and Z. A shield 54 around each spear is movably mounted around each spear so that as the bar 56 passes a median line, the shield 54 rides downwardly enveloping the spear 53 about which it is mounted. Thus the shield 54 contacts the top of the drum D before the spear 53 contacts and penetrates the top of the drum D. The shields 54 (one about each spear) serve to impede and/or dissipate any material thrust upwardly by internal drum pressure through a hole made by a spear.

As shown in FIG. 1, 3, and 7–9, the reception apparatus 70 includes a hopper 72 with a top opening 73 and a bottom opening 74 and has a top area 78 configured for receiving a vibratable basket 90. Vibration isolators 75 (e.g. made of rubber and steel) on the top area 78 of the hopper 72 co-act with vibration rockers 79 on the basket 90. The middle rocker 79 is bolted with a bolt 81 to the middle isolator 75 so that as the basket 90 is vibrated by a vibrator 91, a rocking action is induced on the basket 90.

The basket 90 has a body 92 and, preferably, a removable grid, screen, grid-screen combination, multiple screen unit, or grid-multiple screen unit 94 disposed therein. Lift holes 98 facilitate lifting of the basket 90.

Spray nozzles are used with certain preferred embodiments of this invention to inhibit the undesirable dissemination and dispersion of materials from within a punctured or open container from the time it is opened until its contents has been emptied into the reception apparatus 70. In one embodiment, nozzles 87 (see FIG. 6) are positioned under the bar 56 adjacent the puncturing device 50 to form a fog and/or sheet spray about and over the container(s) as they are punctured and lifted. Material escaping from the container(s) or thrust therefrom by internal pressure encounters the fog and/or spray and falls back on the apparatus 10. In one embodiment, one or more"gun" nozzles 88 is disposed on the apparatus 10 to project a concentrated spray of fluid into a container(s) on the cradle 30 as they tilt over the reception apparatus 70. Preferably one or more "cone" spray nozzles 401 also sprays a cone of fluid into each container as it is tilted. Nozzles 89 may be employed to provide a fog and/or protective fluid sheet over the area of the reception apparatus 70. Any nozzles described herein may be movably mounted and movable to move their corresponding output to a desired location or to direct it at a desired target. Typical flow lines (not shown) are connected to the nozzles and typical controls are used to control flow through them.

In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. Apparatus for emptying at least one sealed container of material, the at least one sealed container having a top and a height and a body within which is held the material, the apparatus comprising a base, a support means movably mounted on the base, the support means for holding the at least one container, the support means having a bottom shelf upon which the at least one container rests, movable puncturing means connected to the support means and movable to puncture the top of the container, stop means secured to the support means for stopping movement of the at least one container as the support means tilts the at least one container, the stop means secured at a point a distance from the bottom shelf of the support which exceeds the height of the at least one container so that the at least one container moves that distance upon tilting to jarringly contact the stop means thereby facilitating removal of the material from the at least one container, and reception means for receiving material flowing from a tilted opened container or containers, the reception means comprising hopper discharge means for receiving the material and for discharging it from the apparatus, vibratable basket means removably disposed within an upper portion of the hopper discharge means, and vibrating means on the vibratable basket means for vibrating the vibratable basket means.

2. The apparatus of claim 1 comprising also first moving means connected to and for moving the movable puncturing means.

3. The apparatus of claim 1 comprising also second moving means connected to and for moving the support means.

4. The apparatus of claim 1 comprising also the movable puncturing means including a single puncturing spear for each of the at least one container and which is movable to puncture the top of the at least one container.

5. The apparatus of claim 1 comprising also releasable retainer means connected to the support means for retaining the at least one container on the support means.

6. The apparatus of claim 1 wherein the at least one container is two or more containers and the support means supports and accommodates the containers simultaneously and a separator is provided between containers to maintain them in spaced apart relation on the support means.

7. The apparatus of claim 1 comprising also direction means on the support means for directing flow of material from the at least one container.

8. The apparatus of claim 1 comprising also at least one fluid spray nozzle for spraying a fog of fluid over and about each container to inhibit material dispersion beyond the fog.

9. The apparatus of claim 1 comprising also at least one fluid spray nozzle for spraying a sheet of fluid about each container.

10. The apparatus of claim 1 including at least one fluid spray nozzle for spraying a fog about the reception means.

11. The apparatus of claim 1 including at least one spray nozzle for spraying a fluid sheet about the reception means.

12. Apparatus for emptying at least one sealed container of material, the at least one sealed container having a top and a height and a body within which is held the material, the apparatus comprising a base, a support means movably mounted on the base, the support means for holding the at least one container, the support means having a bottom shelf upon which the at least one container rests, movable puncturing means connected to the support means and movable to puncture the top of the container, stop means secured to the support means for stopping movement of the at least one container as the support means tilts the at least one container, the stop means secured at a point a distance from the bottom shelf of the support which exceeds the height of the at least one container so that the at least one container moves that distance upon tilting to jarringly contact the stop means thereby facilitating removal of the material from the at least one container, first moving means connected to and for moving the movable puncturing means, second moving means connected to and for moving the movable support means, releasable retainer means connected to the movable support means for retaining the at least one container on the support means, the at least one container is two or more containers and the support means supports and accommodates the containers simultaneously and a separator is provided between containers to maintain them in spaced apart relation on the support means, direction means on the support means for directing flow of material from each container, at least one fluid spray nozzle for spraying fluid over and about each container to inhibit material dispersion beyond the fog, reception means for receiving material flowing from a tilted opened container or containers, the reception means comprising hopper discharge means for receiving the material and for discharging it from the apparatus, vibratable basket means disposed within an upper portion of the hopper discharge means, and vibrating means on the vibratable basket means for vibrating the vibratable basket means.

* * * * *